US006735989B1

(12) United States Patent
Schramm et al.

(10) Patent No.: US 6,735,989 B1
(45) Date of Patent: May 18, 2004

(54) PILFER AND VANDALISM RESISTANT HASP LOCKING MECHANISM

(75) Inventors: Dennis E. Schramm, Fresno, CA (US); Allen E. Alexander, Fresno, CA (US); Harry Wright, Fresno, CA (US)

(73) Assignee: The Vendo Company, Fresno, CA (US)

( * ) Notice: Subject to any disclaimer, the term of this patent is extended or adjusted under 35 U.S.C. 154(b) by 0 days.

(21) Appl. No.: 10/083,621

(22) Filed: Feb. 26, 2002

(51) Int. Cl.[7] ..... E05B 65/48

(52) U.S. Cl. ..... 70/2; 70/4; 70/7; 70/164; 292/283

(58) Field of Search ..... 70/2, 7, 14, 52–56, 70/416, 417, 101, 78, 158, 160, 164, 3–6, 8–13; 292/281, 283, 284

(56) References Cited

U.S. PATENT DOCUMENTS

| | | | | | |
|---|---|---|---|---|---|
| 179,370 | A | * | 6/1876 | Sweeney | 292/284 |
| 218,277 | A | * | 8/1879 | Kilham | 292/284 |
| 516,579 | A | * | 3/1894 | Sully | 292/284 |
| 1,679,648 | A | * | 8/1928 | Carpenter | 70/14 |
| 3,446,046 | A | * | 5/1969 | Randel | 70/101 |
| 4,418,551 | A | * | 12/1983 | Kochackis | 70/18 |
| 4,570,467 | A | * | 2/1986 | Greco | 70/99 |
| 5,172,574 | A | | 12/1992 | Perfetto | 70/56 |
| 5,287,710 | A | | 2/1994 | James | 70/14 |
| 5,457,971 | A | * | 10/1995 | Yamada | 70/208 |
| 5,469,722 | A | | 11/1995 | Ellefsen | 70/56 |
| 5,931,032 | A | * | 8/1999 | Gregory | 70/129 |
| 6,021,884 | A | * | 2/2000 | Tsuchida | 194/335 |

* cited by examiner

*Primary Examiner*—John B. Walsh
(74) *Attorney, Agent, or Firm*—Baker Botts L.L.P.

(57) ABSTRACT

A locking mechanism for securing such enclosures as vending machines is disclosed. A hasp is mounted on the interior of the enclosure and a mounting bracket having a flange and a lock hole is disposed on the exterior of the enclosure. To securely lock the enclosure, a hasp key is passed through an opening in the enclosure proximate the mounting bracket. One end of the hasp key includes an engagement mechanism that engages a hasp key aperture through the hasp. On the other end of the hasp key is a lock hole which is generally aligned with the lock hole on the exterior of the enclosure when the hasp key is engaged. A lock may then be disposed through the lock holes, limiting a would-be intruder's options to gain access to the inside of the enclosure. A sliding T-handle lock cover is also described. The sliding T-handle lock cover includes a flange and slides over a T-handle lock and aligns with a flange of a cover plate. When the flanges of the T-handle lock cover and the cover plate are aligned, a hole in each of the flanges are aligned and a lock may be attached thereto, securing the T-handle lock.

23 Claims, 5 Drawing Sheets

FIG.5
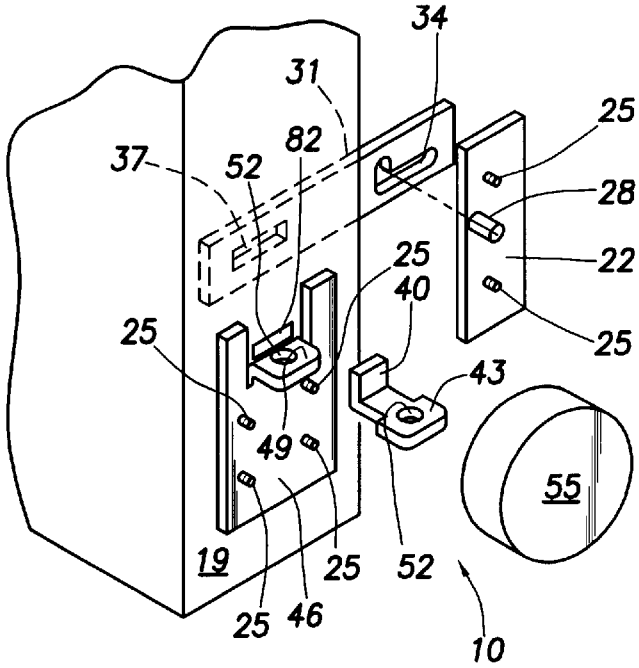
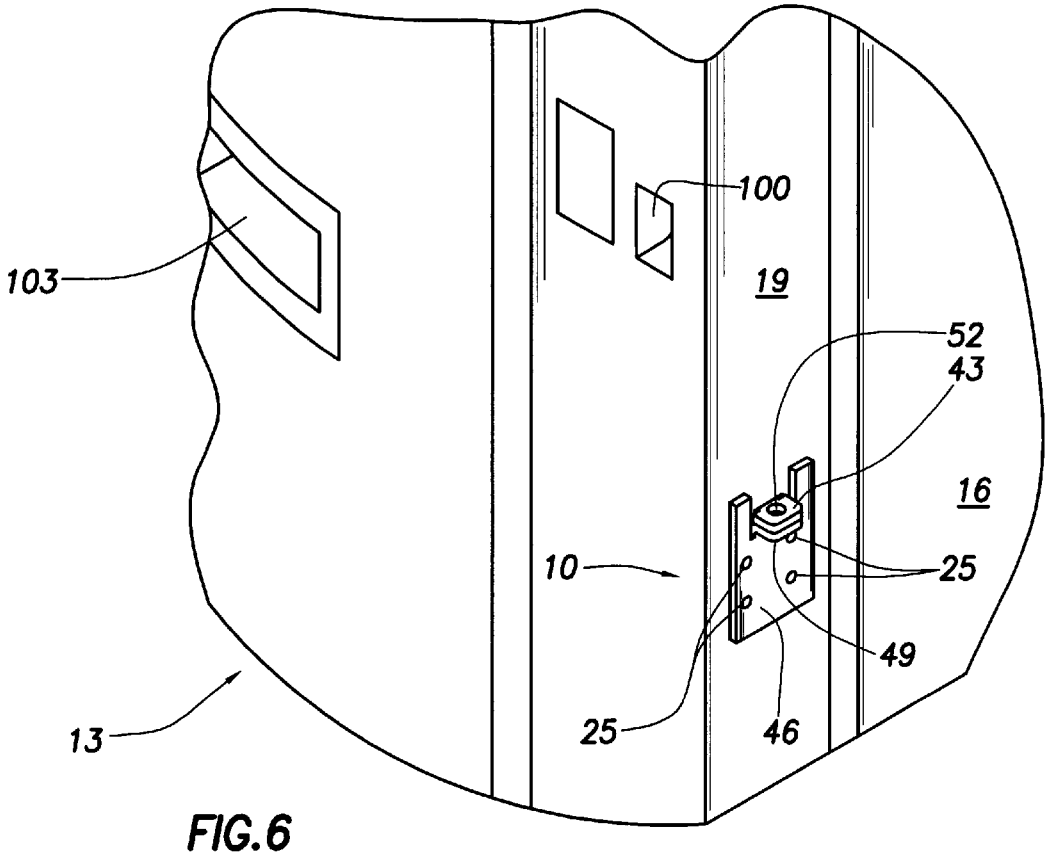
FIG.6

PILFER AND VANDALISM RESISTANT HASP LOCKING MECHANISM

TECHNICAL FIELD OF THE INVENTION

The present invention relates generally to theft prevention and, more particularly, to reducing vending machine pilferage.

BACKGROUND OF THE INVENTION

For as long as distributed, stand-alone or remote assets have existed, so have the opportunists who view each unattended asset as a potential means for income. Unfortunately, for both the distributed asset owners and the consuming public, these opportunists view each unattended asset as a target for theft, not investment. Theft of monies and products from distributed assets, such as vending machines of all sorts, not only takes money directly from the asset's owner, it also forces the asset owner to deflect the losses, both past and future, by raising prices at his other vending machines. In addition, attempted theft from vending machines often results in substantial damage to the vending machine, necessitating the removal and repair of the vending machine. The replacement and repair of damaged vending machines increases the costs of the vending machine owner.

Although some of the items offered in many vending machines are a dollar or less, today's larger vending machines can provide a would-be thief with more than enough motivation to steal. The monetary capacity of many modern vending machines, e.g., those vending machines capable of accepting paper money, can reach six hundred (600) dollars in cash alone. In addition to their capacity for paper money, the same vending machine may also have a coin capacity exceeding one hundred and fifty (150) dollars, making a sold-out machine potentially worth nearly eight hundred (800) dollars. Common attack points for would-be and successful vending machine thieves are typically near the machine's dollar stacker and coin return or coin collection point. While efforts have been made to secure these assets from intrusion, the efforts have either been overcome or are simply ineffective.

One such attempt at securing distributed assets is the T-handle lock included on many beverage vending machines. Vending machine thieves have used a variety of approaches for accessing a vending machine through the T-handle lock of the vending machine. As one example, a problem with T-handle locks is that they typically provide a gap in between the handle and the asset's cabinet. Such a gap enables a thief to insert a pry-bar or similar apparatus therein and to break the handle or lock mechanism using relatively little prying force. In addition, T-handle locks typically include one or more components made from die-cast metal. One problem with die-cast metal is that it will easily shatter from the blow of a hammer or similarly rigid device.

A variety of other external locking mechanisms has been employed to secure distributed assets. However, as a class, they each bear the same shortcoming. By providing an external locking mechanism, the bars to the distributed asset's goods and monies are exposed. As such, a thief can easily determine what it will take to gain entry into a distributed asset. In addition, a thief will be able to position any tools needed for gaining such access, e.g., grinders, files, pry-bars, etc., precisely where their use will be most effective and access most easily gained.

SUMMARY OF THE INVENTION

In accordance with teachings of the present disclosure, a failsafe hasp locking mechanism is provided. In one aspect, the present invention provides a locking mechanism having a hasp including a hasp key aperture, a flange including a lock hole and a hasp key including an engagement mechanism and a lock hole. The hasp is preferably operable to couple to a first component of an enclosure and the flange is preferably operable to couple to a second component of the enclosure. To secure the first component to the second component, the two components forming an enclosure when engaged, the hasp key is preferably passed through a hasp key opening in the enclosure allowing the engagement mechanism to engage the hasp key aperture on the hasp. Once the engagement mechanism is engaged, the lock holes are preferably generally aligned allowing a lock to be coupled thereto, thereby securing the enclosure.

In another aspect, the present invention provides a vending machine including a cabinet having an opening enabling access to an internal compartment thereof, a door for covering the opening coupled to the cabinet and a locking mechanism for securing the door and cabinet in a closed position. The locking mechanism preferably includes an inner hasp mounted internal to the vending machine, a mounting bracket coupled to the vending machine and a hasp key operable to engage a hasp key aperture on the inner hasp such that a lock hole on the hasp key generally aligns with a lock hole on the flange of the mounting bracket thereby enabling the door and the cabinet of the vending machine to be securely locked closed.

In a further aspect, the present invention provides method for securing an enclosure. The method preferably includes passing a hasp key having an engagement mechanism and a lock hole through a hasp key opening in the enclosure. The method preferably also includes engaging the engagement mechanism with a hasp key aperture on a hasp operably coupled to the enclosure and aligning the lock hole on the hasp key with a lock hole on a flange operably coupled to the enclosure.

In yet another aspect, a method for retrofitting a vending machine is provided. The method preferably includes coupling a hasp and a mounting bracket to the vending machine where the hasp preferably includes a hasp key aperture and the mounting bracket preferably includes a flange having a lock hole therein. The method preferably also includes creating a hasp key opening in the vending machine such that when the door and the cabinet are closed, the hasp key aperture engages one end of a hasp key disposed through the hasp key opening and the lock hole on the flange aligns with a lock hole on the other end of the hasp key.

It is an object of the present invention to provide distributed asset managers with a vending machine capable of minimizing losses due to theft and vandalization. It is another object of the present invention to provide a high security locking mechanism that is resistant to removal by prying forces. It is yet another object of the present invention to provide an mechanism and method for retrofitting legacy distributed assets, thereby increasing the legacy distributed assets' resistance to unauthorized intrusion. It is a further object of the present invention to provide an inner hasp locking mechanism for use on vending machines which is resistant to grinding, prying and other conventional means for vending machine break-ins. It is yet a further object of the present invention to provide an internal locking mechanism capable of assuming a safety position whereby a technician can easily and freely restock or service a distributed asset.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 5 is an exploded view, partially in section, of an alternate embodiment of a high security locking mechanism according to teachings of the present invention;

FIG. 6 is a perspective view of a vending machine employing the high security locking mechanism of FIG. 5 according to teachings of the present invention.

DETAILED DESCRIPTION OF THE INVENTION

Embodiments of the invention and its advantages are best understood by referring to FIGS. 1A through 7 of the drawings, like numerals being used for like and corresponding parts of the various drawings. In the detailed description that follows, reference to securing vending machines appears throughout. However, the present invention may be used with a variety of devices or enclosure having items that one wishes to maintain secure. The devices or enclosure that may be employed with the present invention include, but are not limited to, vending machines, cabinets, gun cabinets, safes, closets, tool chests and chests of drawers.

The embodiment described below relates to use of the present invention with a vending machine. A vending machine may vend products including, but not limited to, beverages, snacks, newspapers, magazines, phone cards, music recordings, stamps, hygienic products and personal products. The present invention may also be used with copiers, ice manufacturing and dispensing equipment, as well as other types of equipment, devices or machines. Alternative embodiments of vending machines and devices in general are considered within the scope of the present invention.

Figure 1A:
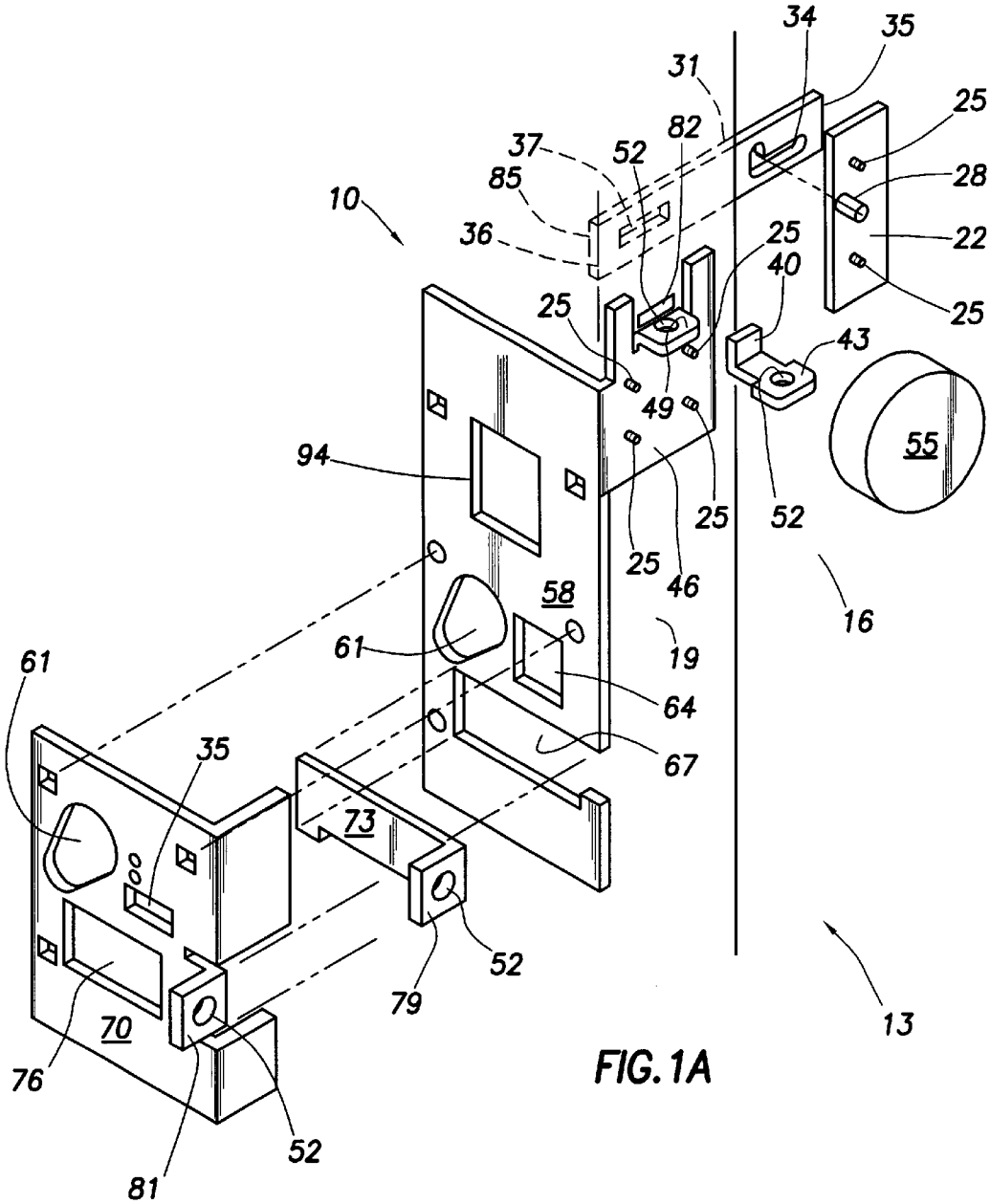
FIG. 1A is an exploded view, partially in section, showing a high security locking mechanism according to teachings of the present invention.

Referring first to FIG. 1A, an exploded view, partially in section, of a high security locking mechanism according to teachings of the present invention is shown. The locking mechanism of the present invention, indicated generally at 10, securely locks vending machine 13 when engaged. Vending machines, such as vending machine 13, generally include a cabinet 16 having an internal compartment (not expressly shown). Vending machine 13 also includes vending hardware and/or inventory dispensing hardware enabling vending machine to accept and respond to consumer selections by dispensing goods from inventory, accepting monies, making change, prompting for additional monies, notifying the consumer of inventory outages, etc.

Vending machine 13 may include a door 19. Door 19 of FIG. 1A generally covers the opening, providing access to the internal compartment of the vending machine, protecting the contents thereof. Many conventional vending machine doors include a purchased goods access point (see FIGS. 6 and 7), currency collection points (see FIG. 7), a change return opening (see FIGS. 6 and 7), a plurality of selection buttons (see FIG. 7), as well as other items. Door 19 may also include a T-handle lock (see FIG. 2), or other mechanism for maintaining door 19 in engagement with cabinet 16.

As illustrated in FIG. 1A, locking mechanism 10 may include a hinge plate 22 mounted on an internal surface of cabinet 16. Hinge plate 22 is coupled to cabinet 16 using attachment mechanisms 25. Attachment mechanisms 25 may include carriage bolts, screws, spot welds, or other attachment means. Further embodiments of the present invention may incorporate hinge plate 22 into the frame of vending machine 13, such as in the frame of cabinet 16 or door 19, may mount hinge plate 22 on an external surface of vending machine 13 or otherwise position hinge plate 22 in accordance with teachings of the present invention. Hinge plate 22 includes pivot post 28 disposed thereon. Pivot post 28 may include a rod, shaft, bolt, screw or other mechanism operable to permit pivoting thereabout.

Figure 1B:
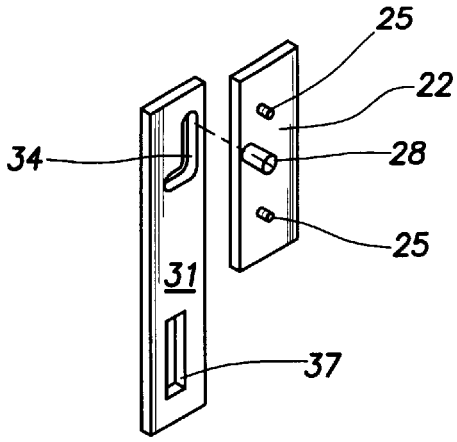
FIG. 1B is an exploded view of an inner hasp and hinge plate, with the inner hasp in a safety position, according to teachings of the present invention.

Coupled to pivot post 28 is inner hasp 31. Inner hasp 31 includes a pivot aperture 34 at one end thereof. Pivot aperture 34 allows inner hasp 31 to pivot between an active or operating position, illustrated in FIG. 1A, and a safety or loading/servicing position, as illustrated in FIG. 1B. To enable inner hasp 31 to pivot and be retained in more than one position, pivot aperture 34 may be L-shaped, although other formations may be readily substituted.

In one embodiment, inner hasp 31 may be maintained in its active position by forming the end of inner hasp 31 such that it engages an inner, rear wall (not expressly shown) of cabinet 16 when inner hasp 31 is pivoted into such a position. Alternatively, hinge plate 22 may be provided with a retaining post (not expressly shown) operable to engage the inner hasp 31 when it is pivoted into its active position such that inner hasp 31 is maintained in its generally horizontal, active position.

In a further embodiment, inner hasp 31 may be coupled directly to cabinet 16, to the frame (not expressly shown) of the vending machine, such as a frame of door 19 or cabinet 16, or in some other manner. In such an embodiment, inner hasp 31 may be coupled such that it is fixed in an active position or coupled such that it may pivot between active and safety positions. Included at end 36 of inner hasp 31 is hasp key aperture 37. Hasp key aperture 37 is operable to receive engagement mechanism 40 of hasp key 43 therein. The engagement of hasp key 43 with inner hasp 31 will be described in greater detail below.

Locking mechanism 10 of the present invention also includes mounting bracket 46 coupled to door 19. Mounting bracket 46 may be coupled to door 19 with attachment mechanisms 25. As mentioned above, attachment mechanisms 25 may includes carriage bolts, screws, spot welds or any other operable attachment means. Mounting bracket 46 includes flange 49 thereon. Flange 49 extends generally perpendicularly from mounting bracket 46. Flange 49 includes lock hole 52 therein. Lock hole 52 of flange 49 and lock hole 52 of hasp key 43 align when locking mechanism 10 is in use such that lock 55 may be engaged therewith to ensure door 19 maintains engagement with cabinet 16 and thereby secure the vending machine's 13 contents. Lock 55 may be any suitable lock, including the disc or hockey-puck shaped padlock shown in FIG. 1A.

In a further embodiment of the present invention, mounting bracket 46 may be internal to door 19 or cabinet 16, such as attached to a frame (not expressly shown). In still a further embodiment, flange 49 may be provided without mounting bracket 46, such as by coupling flange 46 directly to door 19, its frame, cabinet 16, its frame, or otherwise to vending machine 13. Spacer plate 58 may be coupled to mounting bracket 46 to provide added strength to locking mechanism 10, as well as extra protection to vending machine 13. As illustrated in FIG. 1A, spacer plate 58 and mounting bracket 46 may be arranged generally perpendicular to one another. In such an embodiment, spacer plate 58 may engage the front of door 19, near such currency points as a coin slot or cash slot, while mounting bracket 46 engages a side of door 19. Alternative orientations between spacer plate 58 and mounting bracket 46 are considered within the scope of the present invention.

Spacer plate 58 may be formed according to a variety of configurations. As illustrated in FIG. 1A, spacer plate 58 may be designed such that it covers, and thereby adds protection to, the vending machine's 13 currency collection points (see FIGS. 2 and 7). In such an embodiment, spacer plate 58 may include opening 61 providing access to a coin acceptance slot and a coin return button (see FIG. 2). In addition, opening 94 may be provided in spacer plate 58 to allow access to a currency acceptance mechanism (see FIG. 2), such as a bill acceptor. Spacer plate 58 may also include an opening 64 that corresponds to a display feature.

Many conventional beverage vending machines include a T-handle locking mechanism for the purpose of locking door 19 to cabinet 16. As illustrated in FIG. 1A, notch 67 may be included in spacer plate 58 to enable spacer plate 58 to surround such a T-handle lock and dollar bill stacker (not shown). For additional T-handle lock protection, locking mechanism 10 of the present invention may include cover plate 70 and T-handle cover plate 73. Cover plate 70 includes openings 61 and 35, which correspond with openings on plate 58. Cover plate 70 also includes opening 76 to provide a vending machine technician access to vending machine's 13 T-handle lock when T-handle lock cover 73 is removed or slide laterally. Sliding T-handle lock 73 back permits access to the T-handle lock without the necessity of having to remove cover plate 70.

T-handle lock cover 73 includes flange 79 having lock hole 52 disposed therein. Similarly, cover plate 70 includes flange 79 having lock hole 52 disposed therein. Flange 79 of T-handle lock cover 73, when T-handle lock cover 73 is in use, aligns with flange 81 of cover plate 70 such that the lock holes 52 on each generally align with one another. With lock holes 52 generally aligned, a lock may be coupled thereto, enabling T-handle lock cover 73 to be locked securely in place. So long as some portion of T-handle lock cover 73 covers the T-handle lock 88, T-handle lock 88 cannot activated to release the cabinet latch. By locking T-handle lock cover 73 in place, vending machine's 13 T-handle lock is covered, providing added protection from hammer blows, prying forces, or other means commonly employed by thieves attempting to gain unauthorized access to a vending machine.

Locking mechanism 10 of the present invention provides additional security to vending machine when installed. To do so, for example, once mounting bracket 46 and inner hasp 31, as well as their corresponding components, have been installed, hasp key 43 may be inserted through hasp key opening 82 on door 19. By orienting hasp key 31 such that engagement mechanism 40 is generally parallel to the ground, inserting engagement mechanism 40 through hasp key opening 82, through hasp key aperture 37 on inner hasp 31 and then rotating hasp key 43 from vertical to horizontal, engagement mechanism 40 may be made to engage side 85 of inner hasp 31. Once hasp key 43 has been rotated downward, from vertical to horizontal, lock holes 52 on hasp key 43 and flange 49 generally align. Once lock holes 52 are aligned, lock 55 may be coupled thereto, securing door 19 to cabinet 16.

In one embodiment, hasp key 43 and flange 49 are sized such that when lock 55 is secured thereto, a gap less than one-eighth of an inch (⅛") wide exists between vending machine 13 and lock 55. By minimizing the gap between lock 55 and vending machine 13, the difficulty of inserting a prying mechanism between them is increased. Common prying mechanisms, such as pry bars and hammers, require at least a one-quarter inch (¼") wide gap for insertion. The use of a disc top locks also prevents the rotation of the lock as a means of breaking the lock.

The above embodiment of locking mechanism 10 is described with specific reference to inner hasp 31 being mounted to cabinet 16 and mounting bracket 46 being mounted to door 19 of vending machine 13. However, according to teachings of the present invention, inner hasp 31 and mounting bracket 46 may be alternatively coupled. That is, inner hasp 31 may be coupled to door 19 and mounting bracket 46 may be coupled cabinet 16. In addition, inner hasp 31 and mounting bracket 46 may be integrally formed with vending machine 13. Alternative placements, arrangements and orientations are considered within the teachings of the present invention.

Figure 2:
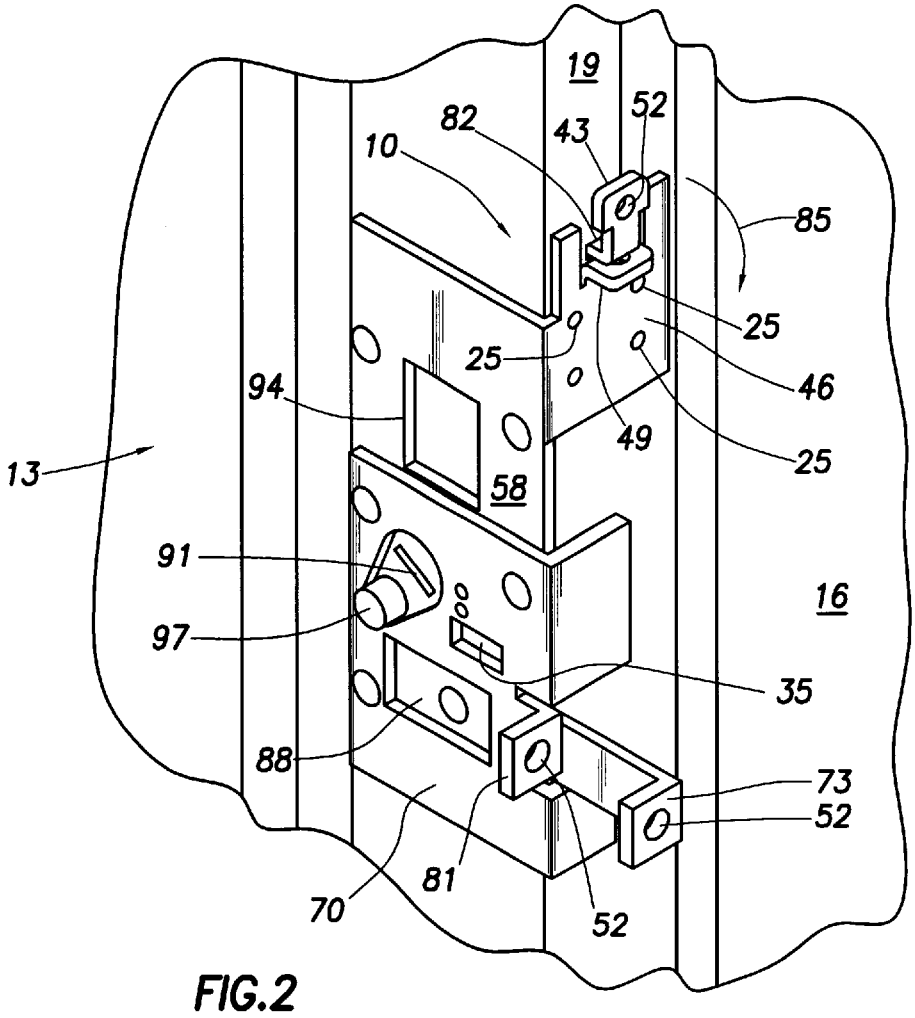
FIG. 2 is a perspective view of a vending machine employing the high security locking mechanism of FIG. 1 according to teachings of the present invention.

Referring to FIG. 2, a perspective view of vending machine 13 employing high security locking mechanism 10 of FIG. 1, according to teachings of the present invention, is shown. In FIG. 2, locking mechanism 10 is disposed proximate the location where the vending machine's 13 bill stacker resides. In doing so, access to the bill stacker is made significantly more difficult. Also shown in FIG. 2 is one method for the insertion of hasp key 43 into hasp key opening 82 on door 19. As mentioned above, hasp key 43 may be inserted into hasp key opening 82 by first orienting hasp key 43 such that engagement mechanism 40 is generally parallel to the ground. Once engagement mechanism 40 is passed through hasp key opening 82, hasp key 43 is then rotated from vertical to horizontal as indicated generally at 85, causing engagement mechanism 40 to engage hasp key aperture 37 of inner hasp 31.

As mentioned above, spacer plate 58, cover plate 70 and T-handle lock cover 73 may be included to provide additional protection to vending machine 13. As shown in FIG. 2, T-handle lock cover 73 is shown disengaged from flange 79 on cover plate 70. In such a position, T-handle lock 88 is exposed. When T-handle lock cover 73 is engaged with cover plate 70, T-handle lock 88 is covered, thereby providing it additional protection from prying forces and impact forces. In addition, the display areas of the vending machine also includes a one-quarter inch thick layer or lens that is composed of polycarbonate material. The placement of the polycarbonate lens over the display areas of the vending machine prevents damage to the display areas or removal of the display areas for access to the lock mechanisms of the vending machine.

Also as mentioned above, spacer plate 58 and cover plate 70 provide additional protection to key components of vending machine 13. For example, coin collection slot 91, paper currency collection mechanism 94 and change return initiator 97 are each provided with additional layers of protection. Alternative arrangements may be developed in accordance with the specific needs of a device to employ locking mechanism 10, according to teachings of the present invention.

Figure 3:
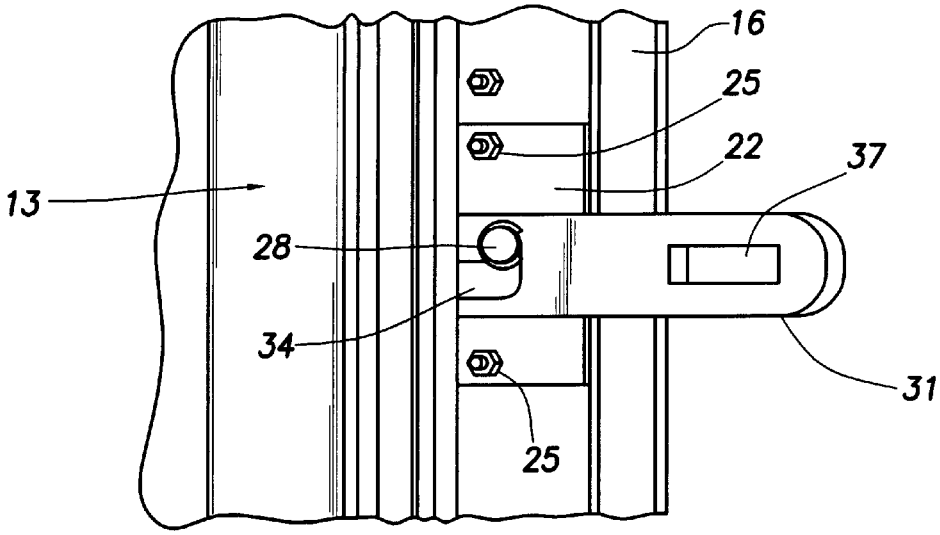
FIG. 3 is a perspective view of an inner pivot hasp in an operating position according to teachings of the present invention.

Shown in FIG. 3 is a perspective view of inner pivot hasp 31 in its operating or active position, according to teachings of the present invention. In its active position, inner hasp 31, when door 19 and cabinet 16 are engaged, is aligned, inside vending machine 13, with hasp key opening 82 on door 19. As such, hasp key 43 may be passed therethrough, allowing lock 55 to engage lock holes 52 on hasp key 43 and flange 49. As mentioned above, the positioning of inner hasp 43, mounting bracket 46, flange 49 and other components of locking mechanism 10 may be altered in accordance with the design specifications of a device to be secured.

Figure 4:
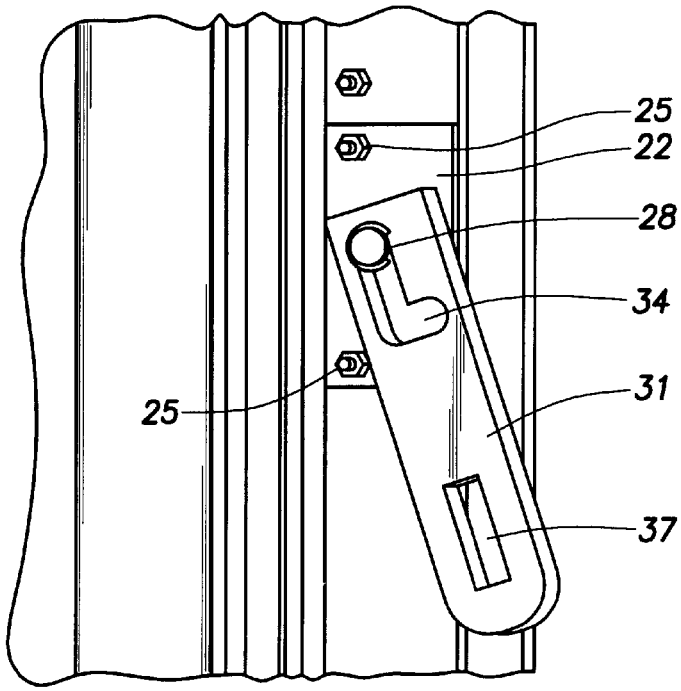
FIG. 4 is a perspective view of an inner pivot hasp in a safety position according to teachings of the present invention.

FIG. 4 shows a perspective view of inner pivot hasp 43 in a loading or safety position, according to teachings of the present invention. As mentioned above, inner hasp 43 may include pivot aperture 34 to enable inner hasp to pivot about pivot post 28. By positioning inner hasp 43 in the safety position illustrated in FIG. 4, a technician loading, maintaining, or otherwise servicing vending machine 13 is less likely to come into contact with inner hasp 43 and therefore less likely to suffer injury as a result of such contact. Embodiments of locking mechanism 10, therefore, may be manufactured such that inner hasp 43 either pivots or does not pivot.

Referring now to FIG. 5, an exploded view, partially in section, of an alternate embodiment of a high security locking mechanism 10 incorporating teachings of the present invention is shown. As mentioned above with reference to FIG. 1, locking mechanism 10 may be designed without the use of spacer plate 58.

Figure 7:
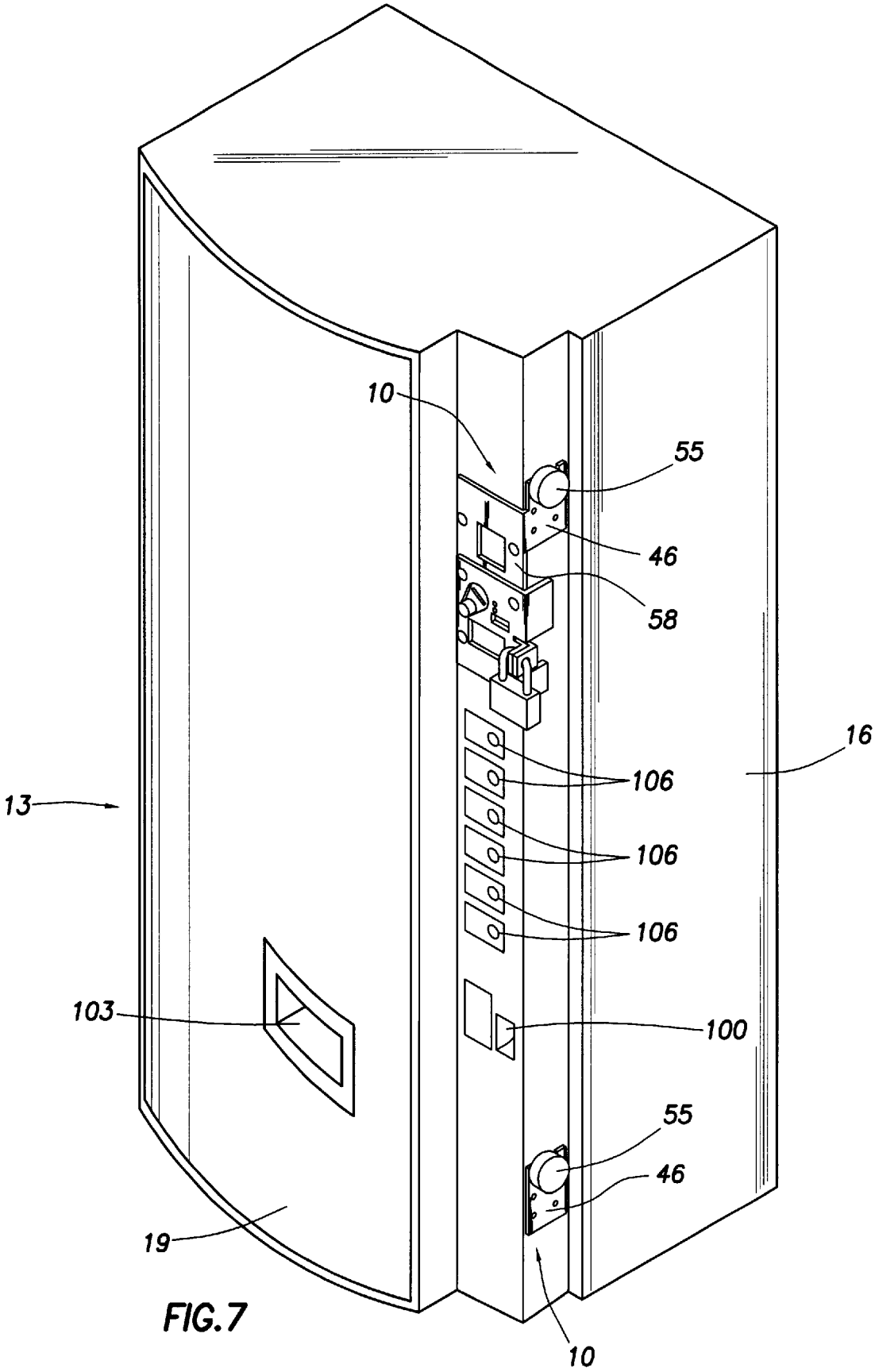
FIG. 7 is a perspective view of a vending machine employing the high security locking mechanism of FIG. 1 and the high security locking mechanism of FIG. 5 according to teachings of the present invention.

In one embodiment, shown in FIG. 7, a vending machine 13 may be provided with a locking mechanism as depicted in FIG. 1 as well as with a locking mechanism as depicted in FIG. 5. In such an embodiment, a locking mechanism 10 such as the one depicted in FIG. 1 may be provided in the area of vending machine 13 housing a bill stacker (not expressly shown) and a locking mechanism 10 as depicted in FIG. 5 may be provided near the bottom of a vending machine 13 where a coin collection point (not expressly shown) is typically housed. However, a locking mechanism 10 as depicted in FIG. 5 may be provided on vending machine 13 or other device on its own, in plurality or with an alternate embodiment of locking mechanism 10.

Shown in FIG. 6 is a perspective view of vending machine 13 employing the high security locking mechanism 10 of FIG. 5, according to teachings of the present invention. As shown in FIG. 6, locking mechanism 10 may be included on vending machine 13, typically where a coin collection apparatus is positioned. In many conventional vending machines 13, a coin collection apparatus is disposed near the bottom of vending machine 13, proximate coin return 100. FIG. 6 also shows dispensing opening 103 typically included on vending machine 13 door 19 providing access to purchased goods.

In FIG. 7, a perspective view of vending machine 13 employing both the high security locking mechanism 10 of FIG. 1 and the high security locking mechanism 10 of FIG. 5, according to teachings of the present invention is shown. As illustrated, vending machine 13 may include some or all of the components referenced throughout as well as selection buttons 106. Vending machine 13 may also assume any of a variety of other forms or embodiments.

As illustrated in FIG. 7, lock 55 may cover a majority of the lower locking mechanism 10, coupled proximate the coin collection point of vending machine 13. As mentioned above, the gap between lock 55 and vending machine is negligible. In doing so, as mentioned above, locking mechanism 10 and lock 55 reduce the risk of entry into vending machine 13 via prying forces. Also, by incorporating inner hasp 31 internal to vending machine 13, inner hasp 31 is protected from such mechanisms as grinders, pry bars, hammers, etc., which provides even further protection from unauthorized access.

Although the present invention has been described with respect to a specific preferred embodiment thereof, various changes and modifications may be suggested to one skilled in the art and it is intended that the present invention encompass such changes and modifications fall within the scope of the appended claims.

What is claimed is:

1. An apparatus for securing a first component to a second component, the first and second components forming an enclosure when engaged, the apparatus comprising:

a hasp having a hasp key aperture, the hasp operable to couple to the first component;

a flange having a lock hole, the flange operable to couple to the second component such that when the first and second components are engaged the flange is disposed proximate the hasp key aperture; and a hasp key having an engagement mechanism and a lock hole, the hasp key operable to pass through a hasp key opening in the enclosure thereby enabling the engagement mechanism to engage the hasp key aperture and the lock holes to generally align with one another such that a lock may be fixed thereto, securing the enclosure;

wherein the hasp is disposed relative to the lock such that the hasp is internal to the enclosure and the lock is external to the enclosure.

2. The apparatus of claim 1 further comprising a mounting bracket operably coupled to the flange, the mounting bracket operable to couple the flange to the enclosure.

3. The apparatus of claim 2 further comprising a spacer plate operably coupled to the mounting bracket.

4. The apparatus of claim 1 wherein the hasp is operable to couple to an inner surface of the enclosure.

5. The apparatus of claim 1 wherein the hasp is operable to couple to a frame component of the enclosure.

6. The apparatus of claim 1 wherein the enclosure is a vending machine having a door and a cabinet.

7. An apparatus for securing a first component to a second component, the first and second components forming an enclosure when engaged, the apparatus comprising:

a hasp having a hasp key aperture, the hasp operable to couple to the first component;

a flange having a lock hole, the flange operable to couple to the second component such that when the first and second components are engaged the flange is disposed proximate the hasp key aperture;

a mounting bracket operably coupled to the flange, the mounting bracket operable to couple the flange to the enclosure;

a spacer plate operably coupled to the mounting bracket;

a hasp key having an engagement mechanism and a lock hole, the hasp key operable to pass through a hasp key opening in the enclosure thereby enabling the engagement mechanism to engage the hasp key aperture and the lock holes to generally align with one another such that a lock may be fixed thereto, securing the enclosure;

a cover plate having a T-handle aperture and a flange with a lock hole disposed therein, the cover plate operable to engage the spacer plate; and a T-handle cover having a flange and a lock hole therein, the T-handle cover operable to engage the T-handle aperture such that the respective lock holes generally align.

8. An apparatus for securing a first component to a second component, the first and second components forming an enclosure when engaged, the apparatus comprising:

a hasp having a hasp key aperture, the hasp operable to couple to the first component;

a flange having a lock hole, the flange operable to couple to the second component such that when the first and second components are engaged the flange is disposed proximate the hasp key aperture;

a hasp key having an engagement mechanism and a lock hole, the hasp key operable to pass through a hasp key opening in the enclosure thereby enabling the engagement mechanism to engage the hasp key aperture and the lock holes to generally align with one another such that a lock may be fixed thereto, securing the enclosure;

a hinge plate having a pivot post; and a pivot aperture disposed on the hasp, the pivot aperture operably coupled to the pivot post such that the hasp is operable to pivot between a safety position and an operating position.

9. A vending machine comprising:

a cabinet having an opening enabling access to an internal compartment of the cabinet;

a door operably coupled to the cabinet, the door operable to cover at least a portion of the opening; and a first locking mechanism operable to secure the door and cabinet in a closed position, the locking mechanism including:

an inner hasp mounted internal to the vending machine, the inner hasp having a hasp key aperture;

a mounting bracket operably coupled to the vending machine, the mounting bracket coupled such that when the door engages the cabinet the mounting bracket is disposed proximate the inner hasp;

a flange having a lock hole, the flange coupled to the mounting bracket such that the flange is disposed proximate the hasp key aperture of the inner hasp when the door engages the cabinet; and a hasp key having a lock hole therein, the hasp key operable to engage the hasp key aperture on the inner hasp such that the lock hole on the hasp key generally aligns with the lock hole on the flange, enabling the door and the cabinet to be locked in the closed position.

10. The vending machine of claim 9 further comprising a spacer plate operably coupled to the mounting bracket.

11. The vending machine of claim 9 further comprising a cover plate operably coupled to the vending machine proximate a currency collection point.

12. The vending machine of claim 9 further comprising a lock operably coupled to the lock holes.

13. The vending machine of claim 9 further comprising inventory dispensing hardware operably coupled to the door and the cabinet.

14. The vending machine of claim 9 further comprising currency collection hardware operably coupled to the door and the cabinet.

15. The vending machine of claim 9 further comprising the inner hasp operably coupled to an interior surface of the cabinet.

16. The vending machine of claim 9 further comprising the mounting bracket operably coupled to an exterior surface of the door.

17. A vending machine comprising:

a cabinet having an opening enabling access to an internal compartment of the cabinet;

a door operably coupled to the cabinet, the door operable to cover at least a portion of the opening;

a first locking mechanism operable to secure the door and cabinet in a closed position, the locking mechanism including:

an inner hasp mounted internal to the vending machine, the inner hasp having a hasp key aperture;

a mounting bracket operably coupled to the vending machine, the mounting bracket coupled such that when the door engages the cabinet the mounting bracket is disposed proximate the inner hasp;

a flange having a lock hole, the flange coupled to the mounting bracket such that the flange is disposed proximate the hasp key aperture of the inner hasp when the door engages the cabinet; and a hasp key having a lock hole therein, the hasp key operable to engage the hasp key aperture on the inner hasp such that the lock hole on the hasp key generally aligns with the lock hole on the flange, enabling the door and the cabinet to be locked in the closed position;

a cover plate operably coupled to the vending machine proximate a currency collection point, the cover plate having a T-handle access aperture, a flange and a lock hole in the flange;

a T-handle cover having a flange and lock hole in the flange; and the T-handle cover operable to engage the T-handle access aperture such that the respective lock holes generally align, enabling a lock to be secured thereto.

18. A vending machine comprising:

a cabinet having an opening enabling access to an internal compartment of the cabinet;

a door operably coupled to the cabinet, the door operable to cover at least a portion of the opening;

a first locking mechanism operable to secure the door and cabinet in a closed position, the locking mechanism including:

an inner hasp mounted internal to the vending machine, the inner hasp having a hasp key aperture;

a mounting bracket operably coupled to the vending machine, the mounting bracket coupled such that when the door engages the cabinet the mounting bracket is disposed proximate the inner hasp;

a flange having a lock hole, the flange coupled to the mounting bracket such that the flange is disposed proximate the hasp key aperture of the inner hasp when the door engages the cabinet; and a hasp key having a lock hole therein, the hasp key operable to engage the hasp key aperture on the inner hasp such that the lock hole on the hasp key generally aligns with the lock hole on the flange, enabling the door and the cabinet to be locked in the closed position;

a hinge plate having a pivot post disposed thereon, the hinge plate operably coupled internal to the vending machine; and a pivot aperture disposed in the inner hasp, the pivot aperture operable to engage the pivot post such that the inner hasp may assume at least a safety position and an operating position.

19. A method for retrofitting a vending machine, the vending machine having a door and a cabinet, the method comprising:

coupling a hasp and a mounting bracket to the vending machine, the hasp having a hasp key aperture and the mounting bracket having a flange including a lock hole and the hasp being disposed internally of the vending machine; and creating a hasp key opening in the vending machine such that when the door and the cabinet are engaged, the hasp key aperture on the hasp is operable to engage a first end of a hasp key disposed through the hasp key opening and the lock hole on the flange is operable to couple a lock to a lock hole on a second end of the hasp key.

20. A method for securing an enclosure comprising:

passing a hasp key through a hasp key opening in the enclosure, the hasp key having an engagement mechanism and a lock hole;

engaging the engagement mechanism with a hasp key aperture on a hasp operably coupled to the enclosure, the hasp being disposed internally of the enclosure; and aligning the lock hole on the hasp key with a lock hole on a flange operably coupled to the enclosure.

21. The method of claim 20 further comprising coupling a lock through the aligned lock holes.

22. The method of claim 20 wherein engaging the engagement mechanism with the hasp key aperture occurs within the enclosure.

23. A method for securing an enclosure comprising:

passing a hasp key through a hasp key opening in the enclosure, the hasp key having an engagement mechanism and a lock hole;

engaging the engagement mechanism with a hasp key aperture on a hasp operably coupled to the enclosure;

aligning the lock hole on the hasp key with a lock hole on a flange operably coupled to the enclosure;

disposing a T-handle cover proximate a T-handle aperture on a cover plate operably coupled to the enclosure such that a lock hole on the T-handle cover and a lock hole on the cover plate are generally aligned; and coupling a lock through the generally aligned lock holes.

* * * * *